US010984740B2

(12) United States Patent
Kim et al.

(10) Patent No.: US 10,984,740 B2
(45) Date of Patent: Apr. 20, 2021

(54) DISPLAY DRIVING DEVICE

(71) Applicant: SILICON WORKS CO., LTD., Daejeon-si (KR)

(72) Inventors: Young Bok Kim, Daejeon-si (KR); Hyun Kyu Jeon, Daejeon-si (KR); Joon Ho Na, Daejeon-si (KR)

(73) Assignee: Silicon Works Co., Ltd., Daejeon-si (KR)

( * ) Notice: Subject to any disclaimer, the term of this patent is extended or adjusted under 35 U.S.C. 154(b) by 215 days.

(21) Appl. No.: 15/439,200

(22) Filed: Feb. 22, 2017

(65) Prior Publication Data

US 2017/0249913 A1 Aug. 31, 2017

(30) Foreign Application Priority Data

Feb. 26, 2016 (KR) ..... 10-2016-0023423

(51) Int. Cl.
*G09G 3/36* (2006.01)

(52) U.S. Cl.
CPC ..... *G09G 3/3614* (2013.01); *G09G 3/3688* (2013.01); *G09G 2310/0251* (2013.01); *G09G 2310/0291* (2013.01); *G09G 2310/061* (2013.01)

(58) Field of Classification Search
CPC .. G09G 3/3614; G09G 3/3685; G09G 3/3688; G09G 2310/0289; G09G 2310/0291; G09G 2310/0294; G09G 2310/0297; G09G 2310/0248; G09G 2310/061
See application file for complete search history.

(56) References Cited

U.S. PATENT DOCUMENTS 6,028,573 A * 2/2000 Orita ..... G09G 3/20 345/60
9,001,019 B2 4/2015 Peng et al.
2002/0171613 A1* 11/2002 Goto ..... G09G 3/3688 345/87
2007/0285412 A1* 12/2007 Yoon-Kyung ..... G09G 3/3688 345/211

(Continued)

FOREIGN PATENT DOCUMENTS

KR 10-2014-0095926 8/2014
KR 10-2014-0125972 10/2014

(Continued)

*Primary Examiner* — William Boddie
*Assistant Examiner* — Jeffrey Parker
(74) *Attorney, Agent, or Firm* — Polsinelli PC

(57) ABSTRACT

Disclosed is a display driving device. The display driving device may include: a buffer circuit including a positive output amplifier and a negative output amplifier; a switch circuit including output switches connected in series between the positive output amplifier and a first source output terminal, between the positive output amplifier and a second source output terminal, between the negative output amplifier and the first source output terminal, and between the negative output amplifier and the second source output terminal, respectively; and a reset circuit configured to reset output terminals of the positive output amplifier and the negative output amplifier to a middle voltage immediately before switching of the switch circuit for polarity inversion of the first and second source output terminals.

8 Claims, 3 Drawing Sheets

(56) References Cited

U.S. PATENT DOCUMENTS

| | | | | |
|---|---|---|---|---|
| 2009/0179699 | A1* | 7/2009 | Higuchi | H03F 3/45968<br>330/260 |
| 2009/0201237 | A1* | 8/2009 | Nishimura | H03F 3/45183<br>345/87 |
| 2014/0184581 | A1* | 7/2014 | Peng | G09G 3/3688<br>345/212 |

FOREIGN PATENT DOCUMENTS

| | | |
|---|---|---|
| KR | 10-1579839 | 12/2015 |
| KR | 10-2016-0026038 | 3/2016 |

* cited by examiner

DISPLAY DRIVING DEVICE

BACKGROUND

1. Technical Field

The present disclosure relates to a display driving device, and more particularly, to a technique for employing a low-voltage element in an output switch.

2. Related Art

In general, a display driving device refers to a device for driving a display panel. The display driving device converts a digital image signal into a source driving signal, and provides the source driving signal to a data line of the display panel.

Such a display driving device includes a digital-analog converter for converting the digital image signal into the source driving signal and an output circuit for transmitting the source driving signal to the data line of the display panel.

The output circuit includes an output amplifier and an output switch, and the output switch has a function of accurately transmitting the source driving signal to the data line of the display panel. The output circuit further includes an output switch which is connected to an adjacent channel in order to perform a polarity inversion function due to the characteristic of an LCM (Liquid Crystal Module).

Recently, a half supply voltage is applied to the output amplifier to have a low-power characteristic. At this time, the use of an element suitable for power supply is required in order to optimize the performance when the half supply voltage is applied.

However, when an element suitable for the output amplifier is used, an element problem or operation problem may occur because the output amplifier has a different operation range from the output switch. For example, the output amplifier is operated in the range of a voltage VTOP and a voltage VMIDDLE or between the voltage VMIDDLE and a voltage VBOTTOM, and the output switch is operated in the range of the voltage VTOP and the voltage VBOTTOM.

Furthermore, when an element suitable for the output amplifier and an element suitable for the output switch are all used, an additional process cost may be required, and the performance may be degraded.

Furthermore, when the element suitable for the output amplifier is just employed for the output switch, the output switch may momentarily deviate from the operation range during a switching operation for polarity inversion, thereby causing a malfunction.

SUMMARY

Various embodiments are directed to a display driving device capable of employing a low-voltage element in an output switch.

Also, various embodiments are directed to a display driving device capable of preventing an output switch from momentarily deviating from an operation range during a switching operation for polarity inversion, thereby employing a low-voltage element in the output switch.

In an embodiment, a display driving device may include: a buffer circuit including a positive output amplifier and a negative output amplifier; a switch circuit including output switches connected in series between the positive output amplifier and a first source output terminal, between the positive output amplifier and a second source output terminal, between the negative output amplifier and the first source output terminal, and between the negative output amplifier and the second source output terminal, respectively; and a reset circuit configured to reset output terminals of the positive output amplifier and the negative output amplifier to a middle voltage immediately before switching of the switch circuit for polarity inversion of the first and second source output terminals.

In another embodiment, a display driving device may include: a positive output amplifier; a negative output amplifier; a first switch circuit including output switches connected in series between the positive output amplifier and a first source output terminal and between the positive output amplifier and a second source output terminal, respectively; and a second switch circuit including output switches connected in series between the negative output amplifier and the first source output terminal and between the negative output amplifier and the second source output terminal, respectively. The first and second switch circuits may be configured to switch in the range of a positive supply voltage of the positive output amplifier and a middle voltage or the range of the middle voltage and a negative supply voltage of the negative output amplifier.

According to the present embodiments, the display driving device may include the output switches connected in series between the output amplifiers and the source output terminals, and operate the output switches in the range of the positive supply voltage and the middle voltage or the range of the middle voltage and the negative supply voltage. Thus, low-voltage elements can be employed in the switch circuit.

Furthermore, since the low-voltage elements employed in the output amplifiers are adapted to the output switch, the process cost can be reduced, the performance of the output circuit can be improved, and the chip area can be reduced.

Furthermore, since the display driving device resets the output terminal of the positive output amplifier immediately before switching of the switch circuit for polarity inversion of the source output terminals, the display driving device can stably drive the display panel, while preventing the output switches from momentarily deviating from the operation range.

DETAILED DESCRIPTION

Figure 1:
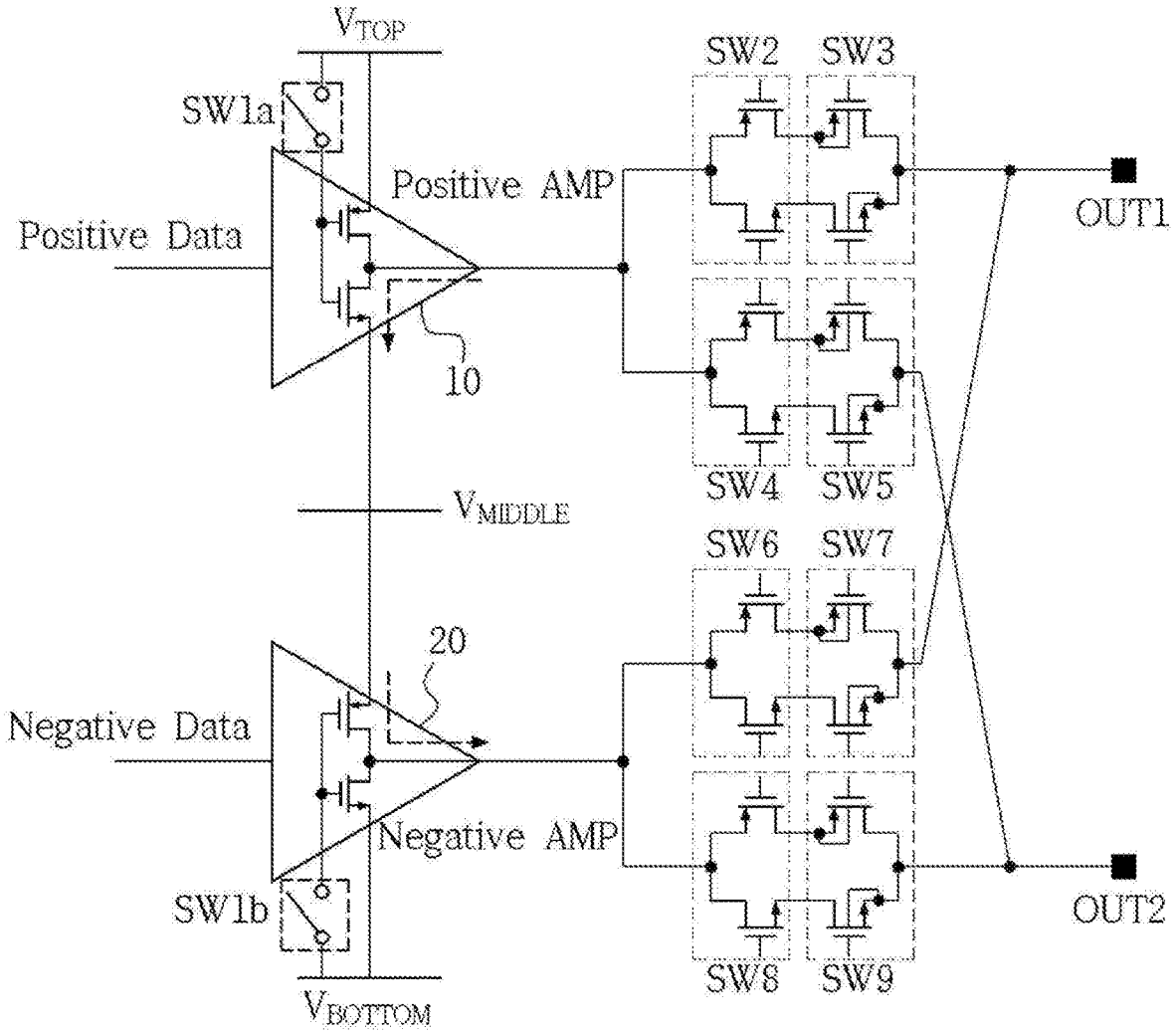
FIG. 1 is a circuit diagram of a display driving device according to an embodiment of the present invention.

Hereafter, embodiments of the present invention will be described in detail with reference to the accompanying drawings. The terms used in the present specification and claims are not limited to typical dictionary definitions, but must be interpreted into meanings and concepts which coincide with the technical idea of the present invention.

Embodiments described in the present specification and configurations illustrated in the drawings are preferred embodiments of the present invention, and do not represent the entire technical idea of the present invention. Thus, various equivalents and modifications capable of replacing the embodiments and configurations may be provided at the point of time that the present application is filed.

A display driving device converts a digital image signal into a source driving signal and provides the source driving signal to a display panel, in order to drive the display panel.

As illustrated in FIG. 1, the display driving device includes many output circuits for transmitting a source driving signal to the display panel.

For convenience of description, FIG. 1 exemplifies that a pair of source driving signals Positive Data and Negative Data having different polarities are buffered and transmitted to a pair of source output terminals OUT1 and OUT2.

FIG. 1 is a circuit diagram of a display driving device according to an embodiment of the present invention.

Referring to FIG. 1, the display driving device according to the present embodiment includes a buffer circuit, a switch circuit and a reset circuit. The buffer circuit includes a positive output amplifier 10 and a negative output amplifier 20, the switch circuit includes output switches SW2 to SW9, and the reset circuit includes reset switches SW1*a* and SW1*b*.

The positive output amplifier 10 buffers a positive source driving signal Positive Data, and the negative output amplifier 20 buffers a negative source driving signal Negative Data.

The positive output amplifier 10 operates in the range of a voltage VTOP to a voltage VMIDDLE, and the negative output amplifier 20 operates in the range of the voltage VMIDDLE to a voltage VBOTTOM.

For example, the voltage VTOP may be defined as a positive supply voltage applied to the positive output amplifier 10, the voltage VBOTTOM may be defined as a negative supply voltage applied to the negative output amplifier 20, and the voltage VMIDDLE may be defined as an average voltage of the voltage VTOP and the voltage VBOTTOM. In this specification, the average voltage is referred to as a middle voltage.

The output switches SW2 to SW9 alternately transmit the positive and negative source driving signals Positive Data and Negative Data to the source output terminals OUT1 and OUT2, in order to prevent sticking of liquid crystal in the display panel.

For example, the output switches SW2 and SW3 transmit the positive source driving signal Positive Data to the source output terminal OUT1 at an odd frame, and the output switches SW4 and SW5 transmits the positive source driving signal Positive Data to the source output terminal OUT2 at an even frame.

Furthermore, the output switches SW8 and SW9 transmit the negative source driving signal Negative Data to the source output terminal OUT2 at an odd frame, and the output switches SW6 and SW7 transmits the negative source driving signal Negative Data to the source output terminal OUT1 at an even frame.

Referring to FIG. 1, the output switches SW2 and SW3 are connected in series between the positive output amplifier 10 and the source output terminal OUT1, and the output switches SW4 and SW5 are connected in series between the positive output amplifier 10 and the source output terminal OUT2.

The output switches SW6 and SW7 are connected in series between the negative output amplifier 20 and the source output terminal OUT1, and the output switches SW8 and SW9 are connected in series between the negative output amplifier 20 and the source output terminal OUT2.

Each of the output switches SW2 to SW9 includes a low-voltage PMOS element and a low-voltage NMOS element which are switched in the same voltage range as a low-voltage PMOS element and a low-voltage NMOS element which are employed in the positive output amplifier 10 and the negative output amplifier 20. For example, the output switches SW2 to SW9 are implemented with transmission gates, and the output switches SW3, SW5, SW7 and SW9 are implemented with transmission gates each including a low-voltage NMOS element and a low-voltage PMOS element of which the sources are connected to the bodies, respectively.

The output switches SW2 to SW9 are configured to switch in the range of the positive supply voltage VTOP and the middle voltage VMIDDLE or the range of the middle voltage VMIDDLE and the negative supply voltage VBOTTOM. The output switches SW2 to SW9 are switched in response to one or more switch control signals among the positive supply voltage, the negative supply voltage and the middle voltage which are applied to the gates thereof. The switch control signal for controlling the switching of the switch circuit may be generated in the display driving device or received from outside. For example, each of the output switches SW2 and SW4 includes a low-voltage NMOS element and a low-voltage PMOS element which are driven in the same voltage range as the positive output amplifier, and each of the output switches SW6 and SW8 includes a low-voltage NMOS element and a low-voltage PMOS element which are driven in the same voltage range as the negative output amplifier 20.

Each of the output switches SW3 and SW5 includes a low-voltage PMOS element and a low-voltage NMOS element. The low-voltage PMOS element fixedly receives the middle voltage VMIDDLE of the buffer circuit through the gate thereof, and the low-voltage NMOS element receives the positive supply voltage VTOP or the negative supply voltage VBOTTOM through the gate thereof, according to a turn-on/off of the output switches SW2 and SW4.

Each of the output switches SW7 and SW9 includes a low-voltage PMOS element and a low-voltage NMOS element. The low-voltage NMOS element fixedly receives the middle voltage VMIDDLE through the gate thereof, and the low-voltage PMOS element receives the positive supply voltage or the negative supply voltage through the gate thereof, according to a turn-on/off of the output switches SW6 and SW8.

The operation of the switch circuit having the above-described configuration is performed as follows.

At a direct path, the output switches SW2, SW3, SW8 and SW9 are turned on, and the output switches SW4, SW5, SW6 and SW7 are turned off. The output switches SW2 and SW3 are turned on to transmit the positive source driving signal Positive Data to the source output terminal OUT1, and the output switches SW8 and SW9 are turned on to transmit the negative source driving signal Negative Data to the source output terminal OUT2.

At this time, although the negative supply voltage VTOP is applied to the source output terminal OUT1, the output switch SW7 is turned off, because the middle voltage VMIDDLE is applied as the switch control signal to the low-voltage NMOS element and the positive supply voltage VTOP is applied to the gate of the low-voltage PMOS element. Furthermore, although the negative supply voltage VBOTTOM is applied to the source output terminal OUT2, the output switch SW5 is turned off, because the middle voltage VMIDDLE is applied to the gate of the low-voltage PMOS element and the negative supply voltage VBOTTOM is applied to the gate of the low-voltage NMOS element.

As a result, the output switch SW7 is operated in the range of the positive supply voltage VTOP and the middle voltage VMIDDLE, and the output switch SW5 is operated in the range of the middle voltage VMIDDLE and the negative supply voltage VBOTTOM.

At a cross path, the output switches SW2, SW3, SW8 and SW9 are turned off, and the output switches SW4, SW5, SW6 and SW7 are turned on. The output switches SW4 and SW5 are turned on to transmit the positive source driving signal Positive Data to the source output terminal OUT2, and the output switches SW6 and SW7 are turned on to transmit the negative source driving signal Negative Data to the source output terminal OUT1.

At this time, although the positive supply voltage VTOP is applied to the source output terminal OUT2, the output switch SW9 is turned off, because the middle voltage VMIDDLE is applied to the gate of the low-voltage NMOS element and the positive supply voltage VTOP is applied to the gate of the low-voltage PMOS element. Furthermore, although the negative supply voltage VBOTTOM is applied to the source output terminal OUT1, the output switch SW3 is turned off, because the middle voltage VMIDDLE is applied to the gate of the low-voltage PMOS element and the negative supply voltage VBOTTOM is applied to the gate of the low-voltage NMOS element.

As a result, the output switch SW9 is operated in the range of the positive supply voltage VTOP and the middle voltage VMIDDLE, and the output switch SW3 is operated in the range of the middle voltage VMIDDLE and the negative supply voltage VBOTTOM.

According to the present embodiment, the output switches are arranged in series between the output amplifiers 10 and 20 and the source output terminals OUT1 and OUT2, and operated in the range of the positive supply voltage VTOP and the middle voltage VMIDDLE or the range of the middle voltage VMIDDLE and the negative supply voltage VBOTTOM. Therefore, since the simultaneous application of the positive supply voltage VTOP and the negative supply voltage VBOTTOM across the output switches is prevented, the low-voltage elements can be employed in the switch circuit.

In the present embodiment, the display driving device may further include a reset circuit while employing the low-voltage elements in the output switches. The reset circuit serves to prevent the switch circuit from momentarily deviating from the operation range due to a difference in transmission speed between the switch control signal and the source driving signal, during a switching operation for polarity inversion of a source output terminal.

The reset circuit can prevent the switch circuit from momentarily deviating from the range of the positive supply voltage VTOP and the middle voltage VMIDDLE or the range of the middle voltage VMIDDLE and the negative supply voltage VBOTTOM. The reset circuit includes reset switches SW1*a* and SW1*b* for resetting the output terminal of the positive output amplifier 10 and the output terminal of the negative output amplifier 20 to the middle voltage immediately before switching of the switch circuit for polarity inversion of the source output terminal.

The reset switches SW1*a* and SW1*b* reset the output terminals of the positive output amplifier 10 and the negative output amplifier 20 to the middle voltage VMIDDLE in response to a reset signal. The reset signal may be defined as a signal which is enabled immediately before switching of the switch circuit for polarity inversion of the source output terminal.

In the present embodiment, the output circuits of the output amplifiers 10 and 20 are used for the reset operation.

For example, the reset switch SW1*a* transmits the positive supply voltage VTOP to the gates of the pull-up element PMOS and the pull-down element NMOS of the positive output amplifier 10 in response to the reset signal. Then, the pull-down element NMOS of the positive output amplifier 10 is turned on, the pull-up element PMOS of the positive output amplifier 10 is turned off, and the output terminal of the positive output amplifier 10 is discharged to the middle voltage VMIDDLE.

The reset switch SW1*b* transmits the negative supply voltage VBOTTOM to the gates of the pull-up element PMOS and the pull-down element NMOS of the negative output amplifier 20 in response to the reset signal. Then, the pull-up element PMOS of the negative output amplifier 20 is turned on, the pull-down element NMOS of the negative output amplifier 20 is turned off, and the output terminal of the negative output amplifier 20 is charged with the middle voltage VMIDDLE.

As such, the display driving device according to the present embodiment transmits the positive and negative source driving signals Positive Data and Negative Data to the source output terminals OUT1 and OUT2. Furthermore, immediately before switching of the switch circuit for polarity inversion of the source output terminals OUT1 and OUT2, the display driving device discharges the output terminal of the positive output amplifier 10 to the middle voltage VMIDDLE and charges the output terminal of the negative output amplifier 20 with the middle voltage VMIDDLE.

The above-described configuration can prevent the output switches from momentarily deviating from the operation range, when the switching circuit for polarity inversion of the source output terminals is switched.

Figure 2:
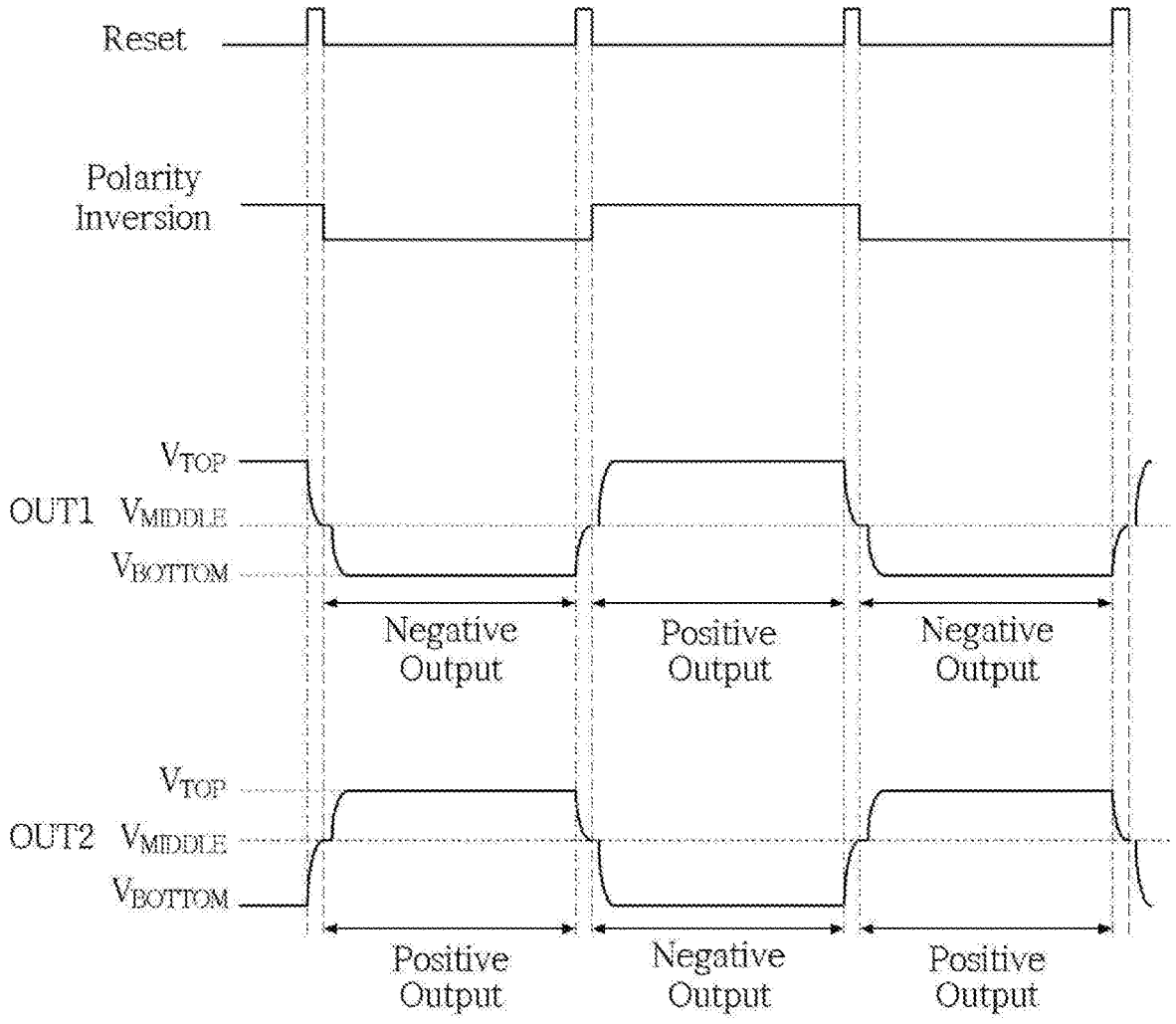
FIG. 2 is a waveform diagram for describing the operation of the display driving device of FIG. 1.

FIG. 2 is a waveform diagram for describing the operation of FIG. 1.

Referring to FIGS. 1 and 2, the reset signal is enabled immediately before switching of the switching circuit for polarity inversion of the source output terminal, and the reset switches SW1*a* and SW1*b* are turned on in response to the reset signal.

As the reset switch SW1*a* is turned on, the pull-down element NMOS of the positive output amplifier 10 is turned on, the pull-up element PMOS of the positive output amplifier 10 is turned off, and the output terminal of the positive output amplifier 10 is discharged to the middle voltage VMIDDLE.

Furthermore, as the reset switch SW1*b* is turned on, the pull-up element PMOS of the negative output amplifier 20 is turned on, the pull-down element NMOS of the negative output amplifier 20 is turned off, and the output terminal of the negative output amplifier 20 is charged with the middle voltage VMIDDLE.

As a result, the source output terminals OUT1 and OUT2 are reset to the middle voltage immediately before polarity inversion.

As such, the display driving device according to the present embodiment may reset the source output terminals OUT1 and OUT2 to the middle voltage VMIDDLE immediately before the switch circuit for polarity inversion of the source output terminals is switched, and prevent the output switches from momentarily deviating from the operation range due to a difference in transmission speed between the switch control signal and the source driving signal when the switch circuit is switched.

Figure 3:
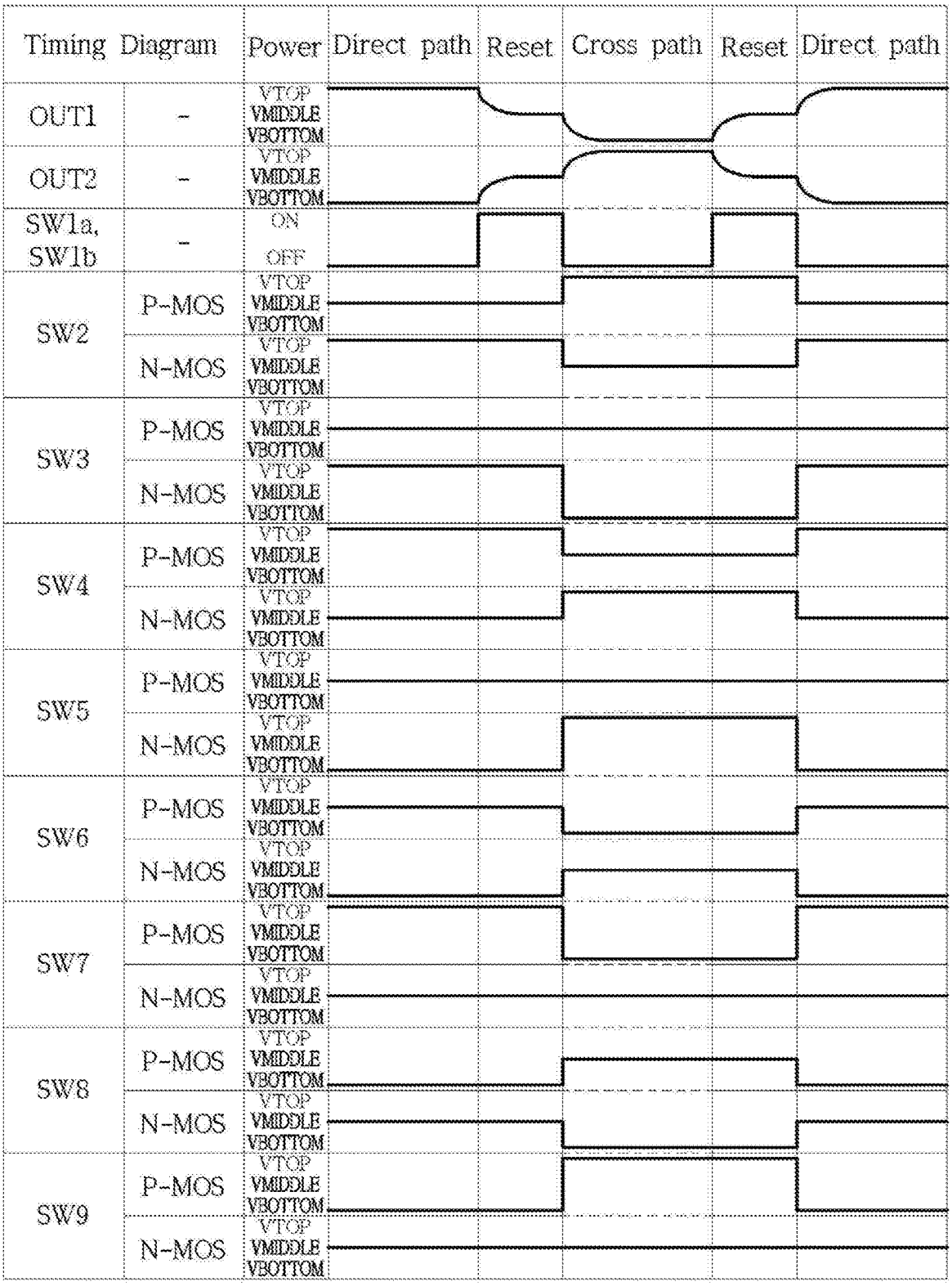
FIG. 3 is a waveform diagram for describing the operation of switches of FIG. 1.

FIG. 3 is a waveform diagram for describing the operation of the switches of FIG. 1.

Referring to FIG. 3, the output switches SW2, SW3, SW8 and SW9 are turned on and the output switches SW4, SW5, SW6 and SW7 are turned off, at the direct path section. Then, the positive source driving signal Positive Data of the positive output amplifier 10 is transmitted to the source output terminal OUT1, and the negative source driving signal Negative Data of the negative output amplifier 20 is transmitted to the source output terminal OUT2.

The reset switches SW1*a* and SW1*b* are turned on at a reset section immediately before the switch circuit for polarity inversion of the source output terminal is switched. Then, the output of the positive output amplifier 10 is pull-down driven, and the source output terminal OUT1 is discharged to the middle voltage VMIDDDLE. Furthermore, the output of the negative output amplifier 20 is pull-up driven, and the source output terminal OUT2 is charged with the middle voltage VMIDDLE.

At the cross path section, the output switches SW4, SW5, SW6 and SW7 are turned on, and the output switches SW2, SW3, SW8 and SW9 are turned off. Then, the positive source driving signal Positive Data of the positive output amplifier 10 is transmitted to the source output terminal OUT2, and the negative source driving signal Negative Data of the negative output amplifier 20 is transmitted to the source output terminal OUT1.

The output switches SW2 to SW9 repeats the above-described operation in order to prevent sticking of liquid crystal in the display panel, and the positive and negative source driving signals Positive Data and Negative Data are alternately transmitted to the source output terminals OUT1 and OUT2 through the output switches SW2 to SW9.

Referring to FIG. 3, each of the output switches SW2 and SW4 includes a low-voltage NMOS element and a low-voltage PMOS element which receive one or more of the positive supply voltage VTOP and the middle voltage VMIDDLE through the gates thereof, and each of the output switches SW6 and SW8 includes a low-voltage NMOS element and a low-voltage PMOS element which receive one or more of the middle voltage MIDDLE and the negative supply voltage VBOTTOM through the gates thereof.

Furthermore, each of the output switches SW3 and SW5 includes a low-voltage PMOS element which fixedly receives the middle voltage VMIDDLE through the gate thereof and a low-voltage NMOS element which receives the positive supply voltage VTOP or the negative supply voltage VBOTTOM through the gate thereof according to a turn-on/off of the output switches SW2 and SW4.

Furthermore, each of the output switches SW7 and SW9 includes a low-voltage NMOS element which fixedly receives the middle voltage VMIDDLE through the gate thereof and a low-voltage PMOS element which receives the positive supply voltage or the negative supply voltage through the gate thereof according to a turn-on/off of the output switches SW6 and SW8.

As described above, the display driving device according to the present embodiment may include the output switches SW2 to SW9 connected in series between the output amplifiers 10 and 20 and the source output terminals OUT1 and OUT2, and operate the output switches in the range of the positive supply voltage and the middle voltage or the range of the middle voltage and the negative supply voltage. Thus, low-voltage elements can be employed in the switch circuit.

Furthermore, since the low-voltage elements employed in the output amplifiers 10 and 20 are adapted to the output switch, the process cost can be reduced, the performance of the output circuit can be improved, and the chip area can be reduced.

Furthermore, the display driving device may discharge the output terminal of the positive output amplifier 10 to the middle voltage VMIDDLE immediately before switching of the switch circuit for polarity inversion of the source output terminals, and charge the output terminal of the negative output amplifier 20 with the middle voltage VMIDDLE. Therefore, the display driving device can stably drive the display panel, while preventing the output switches from momentarily deviating from the operation range.

While various embodiments have been described above, it will be understood to those skilled in the art that the embodiments described are by way of example only. Accordingly, the disclosure described herein should not be limited based on the described embodiments.

What is claimed is:

1. A display driving device comprising:

a buffer circuit comprising a positive output amplifier including a first pull-up element and a first pull-down element and operating in a range of a positive supply voltage and a middle voltage and a negative output amplifier including a second pull-up element and a second pull-down element and operating in a range of the middle voltage and a negative supply voltage;

a switch circuit comprising first and second output switches connected in series between the positive output amplifier and a first source output terminal, third and fourth output switches connected in series between the positive output amplifier and a second source output terminal, fifth and sixth output switches connected in series between the negative output amplifier and the first source output terminal, and seventh and eighth output switches connected in series between the negative output amplifier and the second source output terminal, respectively; and a first reset switch configured to connect the positive supply voltage terminal to gate terminals of the first pull-up element and the first pull-down element of output stage of the positive output amplifier and transmit the positive supply voltage to the gate terminals of the first pull-up element and the first pull-down element to turn off the first pull-up element and turn on the first pull-down element to reset a first output terminal of the positive output amplifier to the middle voltage, wherein the first reset switch is turned on before the first and second output switches of the first switch circuit and the fifth and sixth output switches of the second switch circuit are switched for polarity inversion of the first source output terminal, a second reset switch configured to transmit the negative supply voltage to gate terminals of the second pull-up element and the second pull-down element of output stage of the negative output amplifier to turn on the second pull-up element of output stage of the negative output amplifier and turn off the second pull-down element of the output stage of the negative output amplifier to reset a second output terminal of the negative output amplifier to the middle voltage, wherein the second reset switch Is turned on before the third and fourth output switches, wherein each of the second, fourth, sixth and eighth output switches comprises a low-voltage NMOS element and low-voltage PMOS element, of which source terminals are connected to a body terminal thereof, wherein the first reset switch is connected between a first power terminal to which the positive supply voltage is supplied and the gate terminals of the first pull-up element and the first pull-down element of output stage of the positive output amplifier, wherein the second reset switch is connected between a second power terminal to which the negative supply voltage is supplied and the gate terminals of the second pull-up element and the second pull-down element of output stage of the negative output amplifier.

2. The display driving device of claim 1, wherein the middle voltage is an average voltage of the positive supply voltage of the positive output amplifier and the negative supply voltage of the negative output amplifier.

3. The display driving device of claim 1, wherein the switch circuit comprises:

the first and second output switches connected in series between the positive output amplifier and the first source output terminal;

the third and fourth output switches connected in series between the positive output amplifier and the second source output terminal;

the fifth and sixth output switches connected in series between the negative output amplifier and the first source output terminal; and the seventh and eighth output switches connected in series between the negative output amplifier and the second source output terminal.

4. The display driving device of claim 3, wherein each of the first to eighth output switches comprises a low-voltage NMOS element and low-voltage PMOS element.

5. The display driving device of claim 3, wherein the first to eighth output switches are configured to receive at least one of the positive supply voltage, the negative supply voltage and the middle voltage as a switch control signal, in order to switch in the same operation range as elements of the positive output amplifier and the negative output amplifier.

6. A display driving device comprising:

a positive output amplifier including a first pull-up element and a first pull-down element and operating in a range of a positive supply voltage and a middle voltage;

a negative output amplifier including a second pull-up element and a second pull-down element and operating in a range of the middle voltage and a negative supply voltage;

a first switch circuit comprising first and second output switches connected in series between the positive output amplifier and a first source output terminal and third and fourth output switches connected in series between the positive output amplifier and a second source output terminal, respectively;

a second switch circuit comprising fifth and sixth output switches connected in series between the negative output amplifier and the first source output terminal and seventh and eighth output switches connected in series between the negative output amplifier and the second source output terminal, respectively; and a first reset switch configured to connects positive supply voltage terminal to gate terminals of the first pull-up element and the first pull-down element of output stage of the positive output amplifier and transmit the positive supply voltage to the gate terminals of the first pull-up element and the first pull-down element to turn off the first pull-up element and turn on the first pull-down element to reset a first output terminal of the positive output amplifier to the middle voltage, wherein the first reset switch is turned on before the first and second output switches of the first switch circuit and the fifth and sixth output switches of the second switch circuit are switched for polarity inversion of the first source output terminal; and a second reset switch configured to transmit the negative supply voltage to gate terminals of the second pull-up element and the second pull-down element of output stage of the negative output amplifier to to turn on the second pull-up element and turn off the second pull-down element to reset a second output terminal of the negative output amplifier to the middle voltage, wherein the second reset switch is turned on before the third and fourth output switches of the first switch circuit and the seventh and eighth output switches of the second switch circuit are switched for polarity inversion of the second source output terminal, wherein each of the second, fourth, sixth and eighth output switches comprises a low-voltage NMOS element and low-voltage PMOS element, of which source terminals are connected to body terminals, wherein the first and second switch circuits are configured to switch in the range of the positive supply voltage of the positive output amplifier and the middle voltage or the range of the middle voltage and the negative supply voltage of the negative output amplifier, wherein the first reset switch is connected between a first power terminal to which the positive supply voltage is supplied and the gate terminals of the first pull-up element and the first pull-down element of output stage of the positive output amplifier, and wherein the second reset switch is connected between a second power terminal to which the negative supply voltage is supplied and the gate terminals of the second pull-up element and the second pull-down element of output stage of the negative output amplifier.

7. The display driving device of claim 6, wherein the first and second switch circuits are configured to receive at least one of the positive supply voltage, the middle voltage and the negative supply voltage as a switch control signal.

8. The display driving device of claim 6, wherein the output switches are implemented with transmission gates each including a low-voltage NMOS element and low-voltage PMOS which are switched in the same operation range as elements of the positive output amplifier and the negative output amplifier.

* * * * *